US005331943A

United States Patent [19]

Ko

[11] Patent Number: 5,331,943

[45] Date of Patent: Jul. 26, 1994

[54] WOOD PELLET STOVE

[76] Inventor: Wen-Hsiung Ko, 9, Lane 339, Pei-Yang Road, Fong-Yuan, Taichung Hsien, Taiwan

[21] Appl. No.: 32,253

[22] Filed: Mar. 17, 1993

[51] Int. Cl.[5] ..... F24B 13/04

[52] U.S. Cl. ..... 126/73; 126/68; 126/501; 126/519; 110/267; 110/293

[58] Field of Search ..... 126/73, 501, 519, 523, 126/68; 110/267, 293

[56] References Cited

U.S. PATENT DOCUMENTS

| | | | |
|---|---|---|---|
| 3,260,256 | 7/1966 | Dandini | 126/519 |
| 4,156,418 | 5/1979 | Berg | 126/519 X |
| 4,332,235 | 6/1982 | Hannebaum | 126/519 X |
| 4,922,889 | 5/1990 | Neusmeyer et al. | 126/73 |
| 5,183,028 | 2/1993 | Trager et al. | 126/73 |
| 5,243,963 | 9/1993 | Riener | 126/73 X |

*Primary Examiner*—Larry Jones

*Attorney, Agent, or Firm*—Browdy and Neimark

[57] ABSTRACT

A wood pellet stove comprising a body, a burning means, a heat exchanger means, a waste gas exhaust means, a feeding means, a cleaning means and a control system. The burning means includes a seat member, a container, a bottom member, a top member, two first pillars, two second pillars and a inlet pipe. The cleaning means includes three scrape member. Each of scrape member includes a scrape plate, a pipe, a rod and a hoop element.

15 Claims, 7 Drawing Sheets

WOOD PELLET STOVE

BACKGROUND OF THE INVENTION

The present invention relates to a fireplace, and more particularly to a wood pellet stove.

A conventional fireplace suffers from the following disadvantages:

(1) The poor heat efficiency.

(2) The pipes of heat exchanger will accumulate dirty dirt. The user usually clean the pipes with a brush. But it is not easy to clean completely.

(3) When the internal member(s) had developed trouble, it is difficult to dismount the external body for repairing the member (s) due to the sheets of external body was assembled by means welding.

SUMMARY OF THE INVENTION

A primary object of the present invention is to provide a wood pellet stove having good heat efficiency.

Another object of the present invention is to provide a wood pellet stove having a cleaning means so that the work of clean the pipes of heat exchanger being become easily and completely.

Still another object of the present invention is to provide a wood pellet stove which comprises simple elements of external body and is easy to disassemble.

These and other objects will become apparent from a careful reading of the description provided hereinafter, with appropriate reference to the attached drawings.

DETAILED DESCRIPTION OF THE PREFERRED EMBODIMENT

Figure 1:
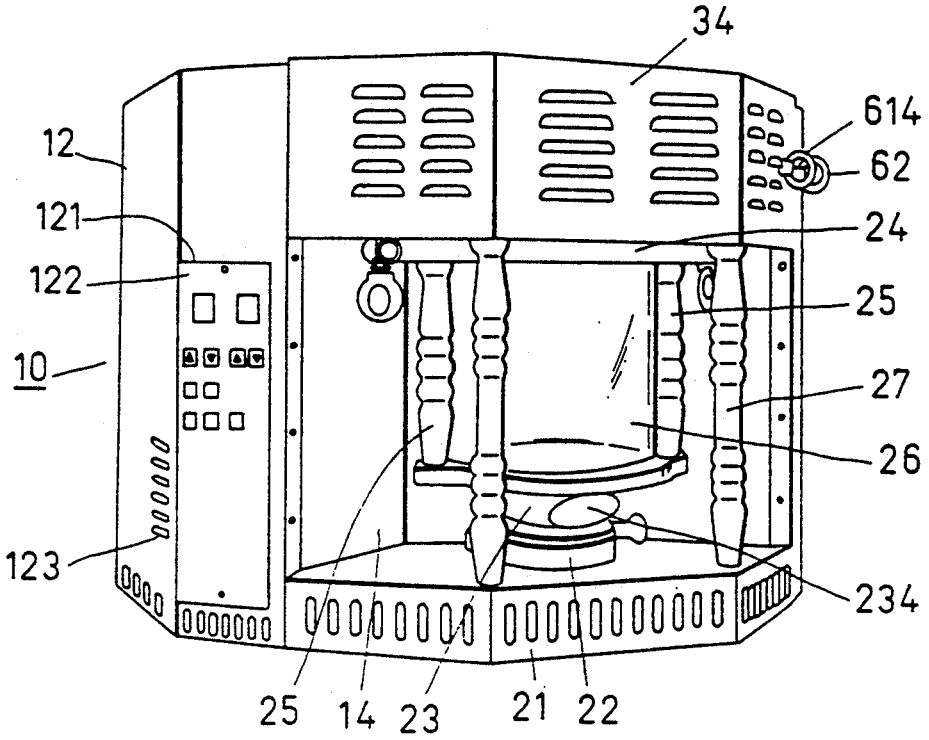
FIG. 1 is a perspective view of a wood pellet stove according to the present invention.
Figure 2:
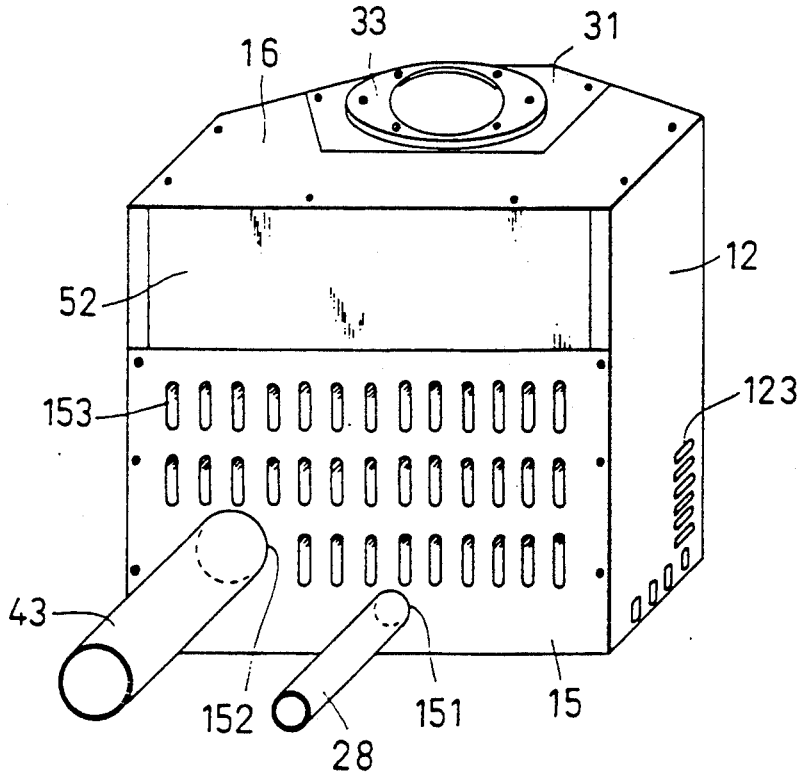
FIG. 2 is a further perspective view of a wood pellet stove according to the present invention.
Figure 3:
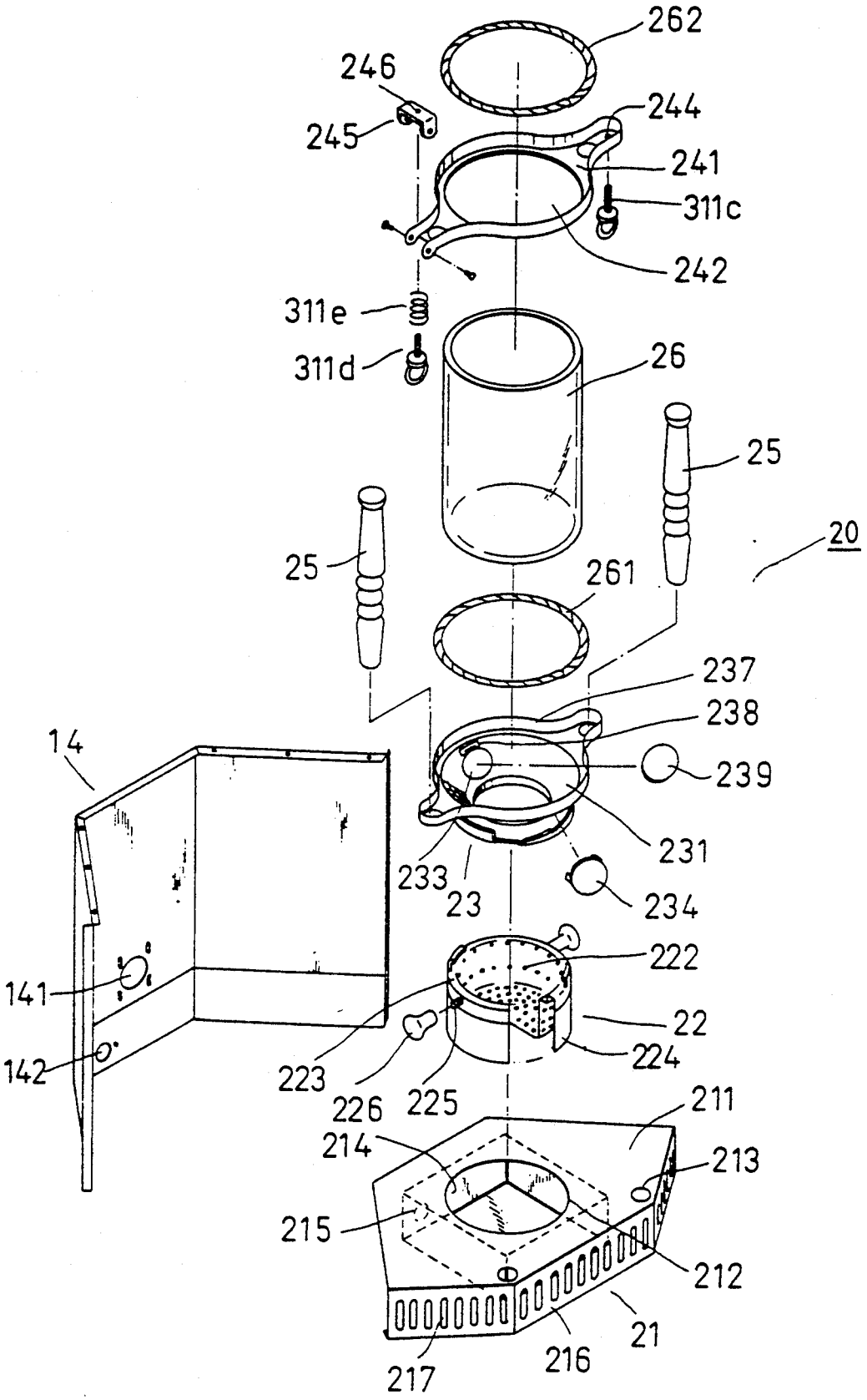
FIG. 3 is an exploded view showing a burning means and middle sheet of a wood pellet stove in FIG. 1.
Figure 4:
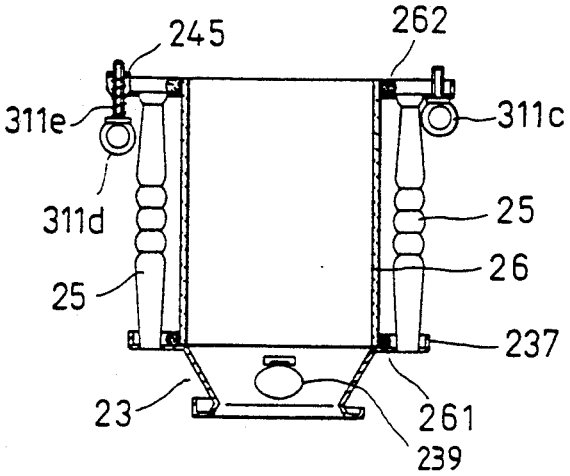
FIG. 4 is a cross-sectional view of a burning means shown in FIG. 3.
Figure 7:
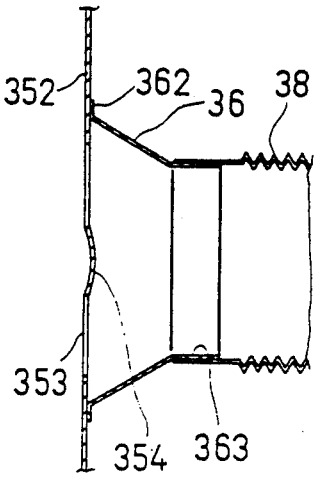
FIG. 7 is a assembly cross-sectional view of the portion A as shown in FIG. 6.
Figure 5:
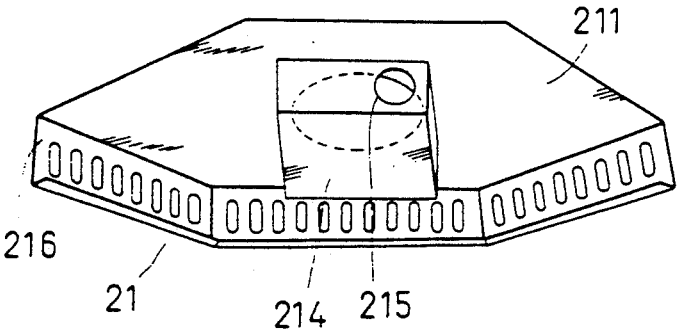
FIG. 5 is a further perspective view of a seat member shown in FIG. 3.
Figure 8:
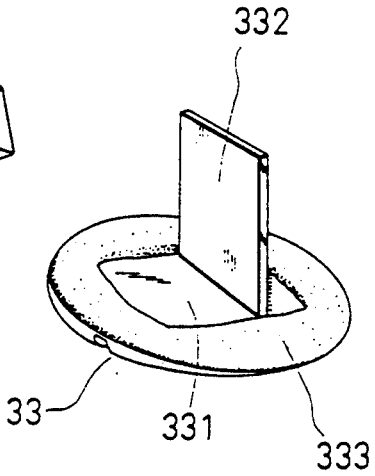
FIG. 8 is a further perspective view of a top partition member in FIG. 6.

Referring now to FIGS. 1–13, a wood pellet stove according to the present invention includes a body 10, a burning means 20, a heat exchanger means 30, a waste gas exhaust means 40, a feeding means 50, a cleaning means 60 and a control system.

The body 10 includes a bottom sheet 11 (see FIG. 10), a left sheet 12, a right sheet 13, a middle sheet 14, a rear sheet 15 and a top sheet 16. Left sheet 12 has a rectangular hole 121 and some first holes 123. A control plate 122 is mounted on rectangular hole 121 and includes some pressing buttons thereon and electronics elements (not shown) at the back. Right sheet 13 has some second holes 131 (see FIG. 10). Middle sheet 14 has a third hole 141 and a fourth hole 142 (see FIG. 3). Rear sheet 15 has a fifth hole 151, a sixth hole 152 and many ventilating holes 153. The sheets 11, 12, 13, 14 & 15 are mounted together by bolts.

Figure 13:
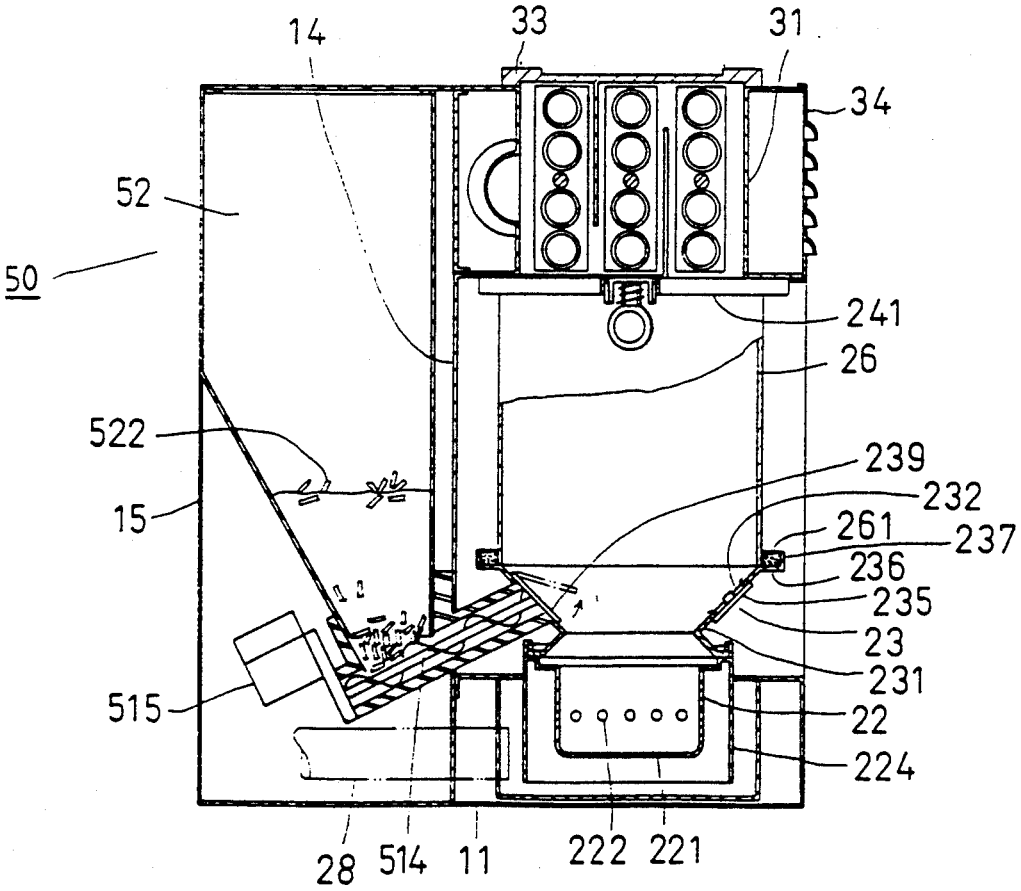
FIG. 13 is a cross-sectional view of a wood pellet stove in FIG. 1.

The burning means 20 includes a seat member 21, a container 22, a bottom member 23, a top member 24, two first pillars 25, a tub 26, two second pillars 27 and a inlet pipe 28 (see FIG. 13). Seat member 21 includes a horizontal plate 211 and a vertical plate 216 (see FIG. 3). Horizontal plate 211 has a seventh hole 212, two eighth holes 213 and a box 214 having at a rear thereof a nineth hole 215. Vertical plate 216 having thereon some tenth holes 217. Container 22 includes a pot portion 221 (see FIG. 13) having thereon many eleventh holes 222, a horizontal circle portion 223 extends outwardly from the top edge of pot portion 221, a vertical tub portion 224 extends downwardly from the outer edge of horizontal circle portion 223 and passes into the seventh hole 212, two screw rods 225 disposed on the opposite sides of the top section of the vertical tub portion 224 and two small handles 226 respectively screwed to rods 225. Bottom member 23 includes a reverse truncated-cone portion 231 having a twelfth hole 232 (see FIG. 13) and a thirteenth hole 233 (see FIG. 3), a cap 234 is covered on the twelfth hole 232, a mounting portion 235 extended downwardly from the bottom edge of truncated-cone portion 231, a bottom plate portion 236 extended outwardly from the top edge of truncated-cone portion 231, a bottom halt tub portion 237 extended upwardly from the out edge of bottom plate portion 236, a pivotal element 238 is fixed above the thirteenth hole 233 and a cover member 239 is pivotally mounted to the pivotal element 238 and covers the thirteenth hole 233. Top member 24 includes a top plate portion 241 having a big hole 242 and a fourteenth hole 244, a top halt tub portion 243 extended from the out edge of top plate portion 241, a reverse U-shape element 245 having a fifteenth hole 246 and fixed on the left side of top halt tub portion 243. Each first pillar 25 having a bottom portion which is fixed to bottom plate portion 236 and a top portion which is fixed to top plate portion 241. Tub 26 is made from heat-resistant and transparent glass material and includes a bottom edge positioned on the top surface of bottom plate portion 236, a top edge positioned in the hole 242 of top plate portion 241, a first fire-resistant cotton rope 261 is bundled around the bottom end of the outer surface of tub 26 and a second fire-resistant cotton rope 262 is bundled around the top end of the out surface of tub 26. Each second pillar 27 has a bottom end inserted and fixed in the eighth hole 213. Inlet pipe 28 has a first section passing through the fifth hole 151, fourth hole 142 and nineth hole 215 in order. The inside end of the first section of inlet pipe 28 is spaced apart from the vertical tub portion 224. The outer section of inlet pipe 28 extends outside of the room.

The heat exchanger means 30 includes a main member 31, a bottom partition member 32, a top partition member 33, a front sheet 34, a closing member 35, a connecting member 36, a first induced draft device 37 (see FIG. 10) and a first guide pipe 38. Main member 31 includes a bottom plate 311 having a rear edge engaged to the top edge of middle sheet 14 by means of welding, a first rectangular hole 312 is formed on the center of bottom plate 311, two vertical plate 313 respectively having twelve sixteenth holes 314 disposed in three vertical rows of four holes fixed above the left and right edge of the first rectangular hole 312 by means welding, twelve pipe members 315 having two opposite ends respectively fixed in sixteenth holes 314 by means welding, three screw holes 316 dispose on the middle section of the right vertical plate 313 and, a front plate 317 fixed to the front edge of the first rectangular hole 312 by means welding, a rear plate 318 fixed to the rear edge of the first rectangular hole 312 by means welding, a horizontal passage member 318*a* integrally formed to the middle section of rear plate 318 and having a halt-circle cross section and a opening portion 318*b* dispose at the right side, and a top plate 319 having the same shape as the bottom plate 311 and having a second rectangular hole 319*a* fixed to the top edge of vertical plate 313, front plate 317 and rear plate 318 by means welding. L-shaped bottom partition member 32 has a horizontal plate portion 321 and a vertical plate portion 322. Horizontal plate portion 321 is fixed to the bottom of bottom plate 311 by means two bolts. Vertical plate portion 322 is disposed between the first and the second file pipe members 315. The height of vertical plate portion 322 is slightly higher than the third pipe 315 when counted from bottom. Top partition member 33 includes a base plate 331, a partition plate 332 extending from the bottom of base plate 331. A fire-resistant cotton pad 333 is provided on the bottom of base plate 331 (see FIG. 8). The base plate 331 cover is fixed to the top surface of top plate 319 by means some bolts so that the second rectangular hole 319*a* is covered. Partition plate 332 is disposed between the second and the third pipe 315 when counted from the front. The height of the bottom edge of partition plate 332 is lower than the bottom of the second rank pipe 312 when counted from the bottom. Front plate 34 includes a middle plate portion 341, a left plate portion 342 extending from the left edge of middle plate portion 341, a right plate portion 343 extending from the right edge of middle plate portion 341 and having a first penetrate hole 345, and a plurality of seventeenth holes 344 disposed on the middle, left and right plate portion 341, 342, 343. Closing member 35 includes a middle plate portion 351, a left plate portion 352 extending from the left edge of middle plate portion 351, a plurality of eighteenth holes 353 disposed on left plate portion 352, a plurality of connecting portion 354 respectively disposed between any two eighteenth holes 353 and having a convex surface, a right plate portion 355 extending from the right edge of middle plate portion 351 and having a nineteenth, twentieth and twenty-first hole 356, 357, 358. Connecting member 36 includes a truncated-cone portion 361, a ring plate portion 362 extending outwardly from the outer edge of the big diameter end of portion 361 fixed to the outer surface of left plate portion 352 so that the big diameter end aligns with the eighteenth holes 353, and a tub portion 363 extending from the small diameter end of portion 361. The first induced draft device 37 is mounted to the bottom sheet 11 and behind the middle sheet 14, and has a draw portion near first hole 123. The first guide pipe 38 has a first end connecting to the exit portion of the first induced draft device 37 and a second end mounting to tub portion 363. Moreover, bottom plate 311 further has a left screw hole 311*a* and a right screw hole 311*b*. A right bolt member 311*c* passes through the fourteenth hole 244 and threads to right screw hole 311*b*. A left bolt member 311*d* passes through a compression spring 311*e* and the fifteenth hole 246 and threads to left screw hole 311*a*, to position burning means 20 below heat exchanger 30 on bottom plate 311. Then, the top edge is mounted thereto mounting portion 235 of bottom member 23. Besides, the top end of the second pillar 27 is fixed to the front section of said bottom plate 311.

Figure 10:
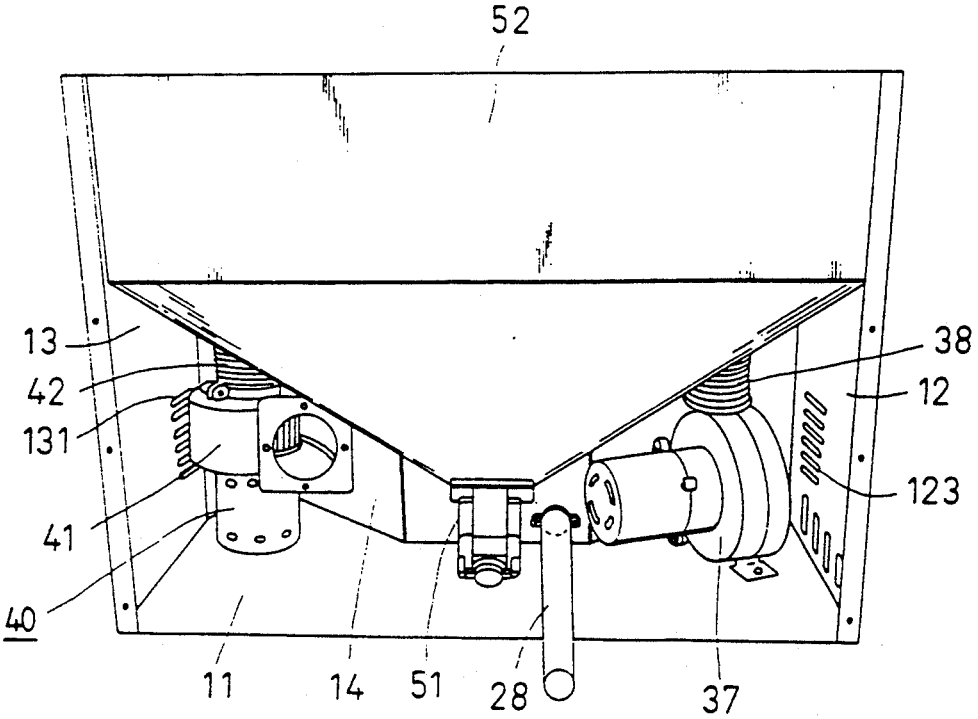
FIG. 10 is a rear perspective view showing a wood pellet stove in FIG. 1, and the rear sheet is dismounted.
Figure 12:
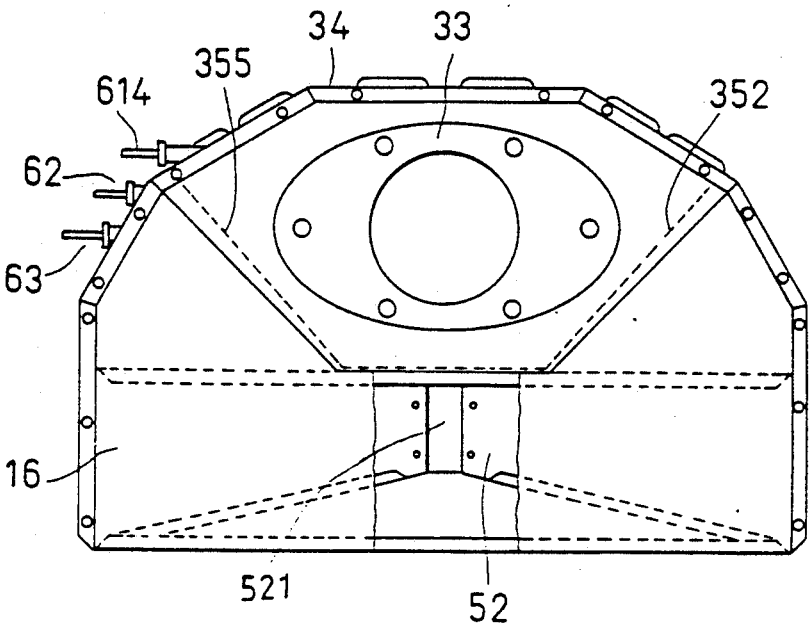
FIG. 12 is a top plane view of a wood pellet stove in FIG. 10.

As shown in FIG. 10, the waste gas exhaust means 40 includes a second induced draft device 41, a second guide pipe 42 and a third guide pipe 43. The second induced draft device 41 is mounted thereon bottom sheet 11 and near right sheet 13. Second guide pipe 42 has a first end passing through the twenty-first hole 358 connected to opening portion 318*b* and a second end mounted to the draw portion of the second induced draft device 41. The third guide pipe 43 having a first end passing through the sixth hole 152 and connected to the exit portion of the second induced draft device 41, and a second end reaching to an outside of the room.

Figure 11:
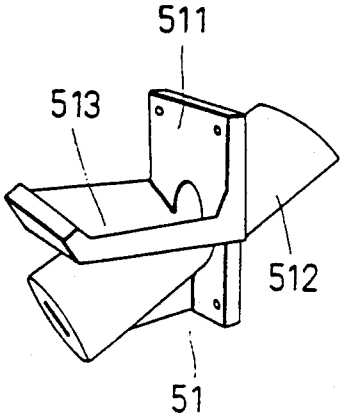
FIG. 11 is a perspective view showing a feeding member of a wood pellet stove in FIG. 10.

The feeding means 50 includes a feeding device 51 (see FIG. 10) and a wood pellet container 52. As shown in FIG. 11, feeding device 51 includes a fixing portion 511 fixing to the back of middle sheet 14 by means of bolts, a pipe body portion 512 penetrating the fixing portion 511 and passing through the third hole 141, a sustain portion 513 is formed on the upper of the rear section of pipe body portion 512 and communicating with the middle section of the axis hole of pipe body portion 512, a screw lift shaft 514 is received in the pipe body portion 512, and a driving device 515 mounted on the back of pipe body portion 512. Moreover, the front end of pipe body portion 512 direct at the thirteenth hole 233 and cover member 239. Container 52 is mounting under the top sheet 16 and has a fall portion 521 direct at the sustain portion 513, and has a receiving space for receiving wood pellets 522.

Figure 6:
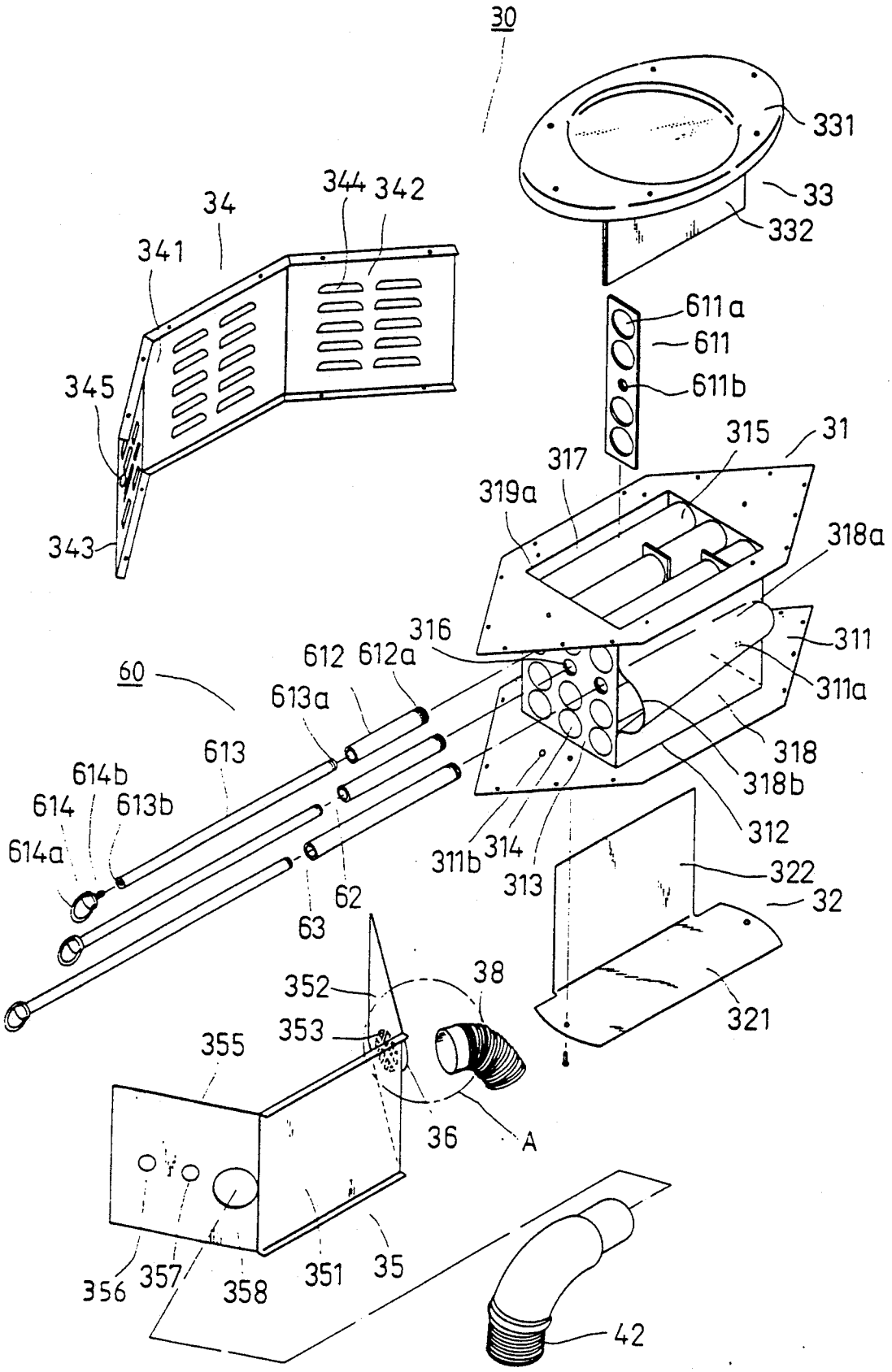
FIG. 6 is an exploded view showing a heat exchanger means of the wood pellet stove in FIG. 1.

As shown in FIG. 6, the cleaning means 60 includes a first scrape member 61, a second scrape member 62 and a third scrape member 63. The first scrape member 61 includes a scrape plate 611, a first pipe 612, a first rod 613 and a hoop element 614. The first scrape plate 611 having four twenty-second holes 611*a* and a small screw hole 611*b* dispose at the middle section. The twenty-second holes 611*a* respectively slidably engage around the first file pipe member 315. The screw hole 611*b* direct at the screw hole 316 of right vertical plate 313. The first pipe 612 having a threaded end is screwed to the first screw hole 316 and another end is disposed in the first penetrate hole 345. The first rod 613 having a threaded end 613*a* passing through the axis hole of the first pipe 612 and screwed to the screw hole 611*b* of scrape plate 611. A first mounting portion 613*b* is formed at another end of the first rod 613. The first mounting portion 613*b* is a screw hole. Hoop element 614 disposed at the outside of front sheet 34 and has a ring portion 614*a* and a second mounting portion 614*b*. The second mounting portion 614*b* has an outside thread screwed to the first mounting portion 613*b*. The second and third scrape member 62, 63 are similar to the first scrape member 61 with only the length of pipe and rod longer than the first pipe and rod 612, 613.

The control system comprises some IC and electronics elements which are disposed on the back of control plate 122 and includes means for control of the dropping quantity of wood pellet of feeding means 50 and setting of the blowing volume of the first induced draft device 37.

Figure 9:
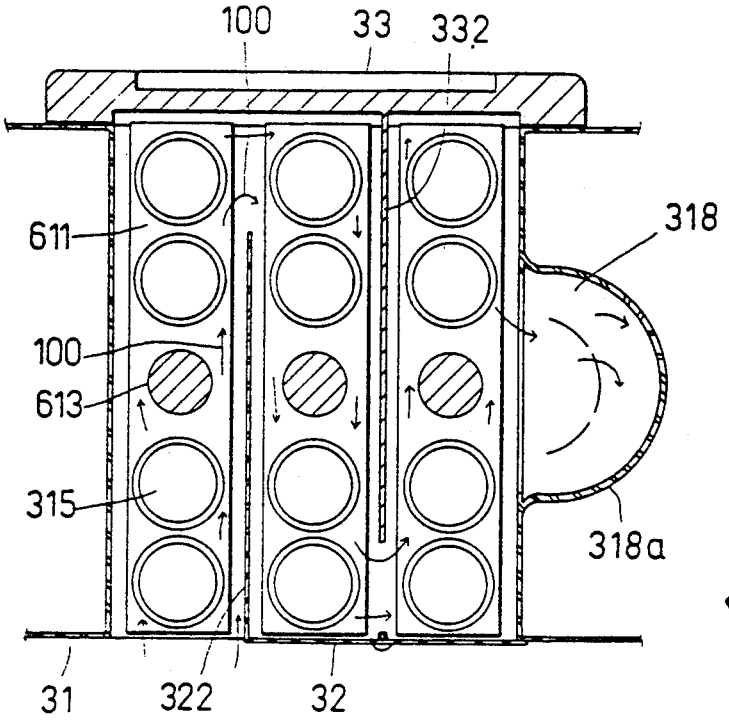
FIG. 9 is a partly and assembly cross-sectional view of FIG. 6.

When the wood pellet stove is to be used the power switch button is pressed to cause the control system to make the driving device 515 of feeding means 50 begin to work. The driving device 515 is energized to drive the screw life shaft 514 means into rotation and the wood pellets 522 will be conveyed forward to push the cover member 239, and then through the bottom member 23 and then drop into the container 22. At this point, the user dismounts the cap 234 and places an igniter into container 22 to ignite the wood pellets. Then, cap 234 is re-mounted to the bottom member 23. At present, the burning flame will rise upward to the tub 26. The fresh air enters box 214 from inlet pipe 28 continuously. The flame can't directly blow all pipe members 315 due to the separatings of partition plate 332 and vertical plate portion 322. Referring to FIG. 9, the hot air produce by flame will follow in a direction indicated by an arrow 100 and blow the first, the second and the third pipe members 315 in order. Finally, the waste gas will flow from the opening portion 318*b* through the second guide pipe 42 and be exhausted to the outdoor by waste gas exhaust means 40. At this point, the first induced draft device 37 draws the cold air of the room and carrying through the first guide pipe 38 and connecting member 36. Then, the air can equally blow through all pipe members 315 due to the special design of the eighteenth holes 353. The cold air flowing through the pipe members 315 becomes hot air due to the pipe members 315 being continuously by hot air of the flame. Afterwards, the hot air will flow out from the right end of pipe members 315, and then flow indoors through the seventeenth holes 344. Thus, the temperature of indoor will be raised gradually to the preset temperature. Furthermore, the control system can control the quantity of wood pellet by means of measuring the indoor temperature at all times and thereby regulate the magnitude of flame.

Figure 14A:
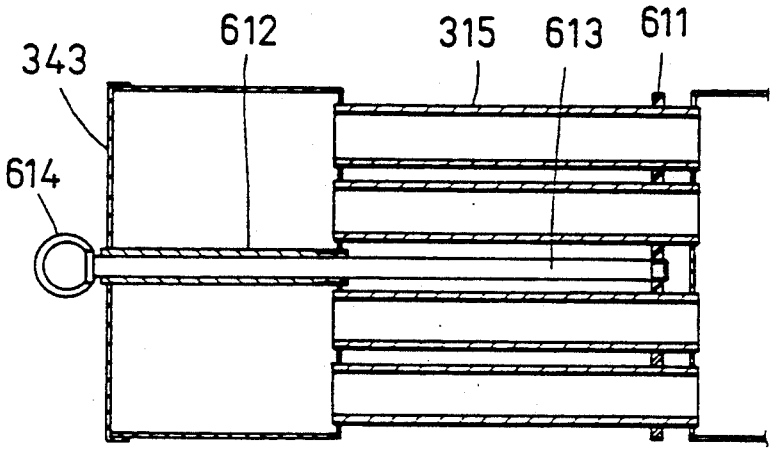
FIGS. 14 A and 14 B are schematic views of operation of the cleaning means according the present invention.
Figure 14B:
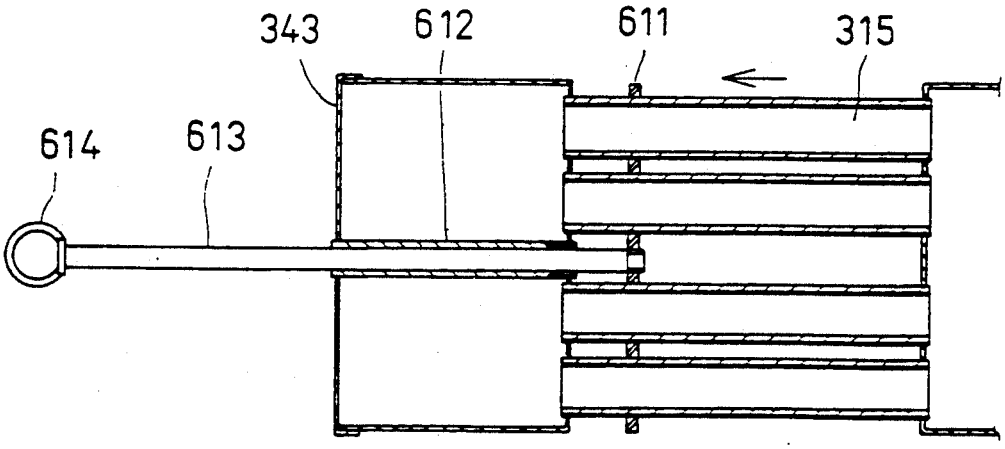

Referring next to FIGS. 14 A and 14 B, the clean work of pipe members 315 is very simple, The user pull the first rod 613 and make the first scrape plate 611 to move from left side to right side, so that the scrape plate 611 will scrap the accumulated dirt of the first pipe members 315 by means of the circular edge of the seventeenth hole 611*a*. The second and the third scrape member 62, 63 are operated same as the first scrape member 61.

Because the wood pellet are almost burning so that the waste of wood pellet are very little. Thus, the container 22 only need clean once after used for a long time. When the container 22 has much waste, the user can dismount easily from the bottom member 23. Then, take the container 22 from the seat member 21 and sort out the waste.

The wood pellet stove as embodied in the present invention have the following advantages over the prior art:

(1) The tub 26 of burning means 20 con concentrates the flame so it can't be spread out and lost.

(2) The flame blows equally over all pipe members 315 due to the special design of the top and bottom partition member 33, 32 and can avoid the flame lean to blow which one file pipe member 315, and reduce the heat efficiency.

(3) The work of clean the pipe members 315 of heat exchanger means 30 is easily and completely by means the singular design of cleaning means 60.

(4) The sheets of body 10 and front sheet 34 are assembled by means bolt members so that the body 10 is easy to disassemble for repairing.

While a preferred embodiment of the present invention has been described as above, it is apparent to those skilled in the art that various modifications and changes can be made to the above-described structure without departing the spirit and scope of this invention.

What is claimed is:

1. A wood pellet stove comprising:

a body having:

a bottom sheet;

a left sheet mounted on the left side of said bottom sheet and having a plurality of holes for ventilation;

a right sheet mounted on the right side of said bottom sheet;

a rear sheet mounted on the rear edge of said bottom sheet, left sheet and right sheet, and a top sheet mounted on the top edges of said left sheet and right sheet;

a burning means having:

a seat member mounted on said bottom sheet, said seat member having a horizontal plate with a mounting hole and a box engaged under said mounting hole, and a vertical plate engaged to said horizontal plate;

a container having a pot portion with a plurality of holes, a horizontal circle portion extending outward from a top edge of said pot portion, a vertical tub portion extending downward from an outer edge of said horizontal circle portion and engaged in said mounting hole of said seat member and two handles respectively secured on the two opposite sides of said vertical tub portion;

a bottom member having a reverse truncated-cone portion having a fuel inlet hole and an ignition hole, a cap covering said ignition hole, a mounting portion extending downward from a bottom edge of said truncated-cone portion engaged to said container, a bottom plate portion extending outward from a top edge of said truncated-cone portion, a bottom flange portion extending upward from an outer edge of said bottom plate portion, and a pivoting cap covering said fuel inlet hole fixed above said fuel inlet hole;

a top member having a top plate portion having a hole and a top flange portion extending from an outer edge of said top plate portion;

two first pillars respectively having a first end engaged to said bottom plate portion and a second end engaged to said top plate portion;

a tub made from heat-resistant and transparent glass material having a bottom end engaged to a top surface of said bottom plate portion and a top end engaged under said hole of said top member;

a first fire-resistant cotton rope wrapped around an outer surface of said bottom end of said tub;

a second fire-resistant cotton rope wrapped around an outer surface of said top end of said tub; and an air inlet pipe having an end spaced from said vertical tub portion, said air inlet pipe passing through said box, said middle sheet and said rear sheet to an outside atmosphere, a heat exchanger means having:

a main member including a bottom plate having a rear edge engaged to a top edge of said middle sheet, a first rectangular hole at a center of said bottom plate, two vertical plates respectively having holes engaged around opposite ends of twelve pipes, said pipes disposed in three vertical rows of four pipes of said twelve pipes, said twelve pipes located above a right edge of said first rectangular hole, three screw holes dispose at a middle section of a right vertical plate of said two vertical plates, said three screw holes having three guide pipes threaded therein, a first front plate fixed to a front edge of said first rectangular hole, a rear plate fixed to a rear edge of said first rectangular hole, a horizontal passage member integrally formed to a middle section of said rear plate and having a half circle cross section and a opening portion disposed at a right side, and a top plate having a shape similar to said bottom plate and engaged to a top edge of said two vertical plates, said first front plate and said rear plate;

a second front plate having a middle plate portion, a left plate portion extending from the left edge of said middle plate portion, a right plate portion extending from the right edge of said middle plate portion, and a plurality of ventilation holes disposed on said middle plate portion, said left plate portion and said right plate portion;

a closing member having a middle plate portion, a left plate portion extending from a left edge of said middle plate portion, a plurality of holes for ventilation dispose on said left plate portion, and a right plate portion extending from a right edge of said middle plate portion, a connecting member having a truncated-cone portion, a ring plate portion extending outwardly from the outer edge of an first end of said truncated-cone portion;

a first induced draft device mounted on said bottom sheet and behind said middle sheet, and having a draw portion near said ventilation holes in said left sheet; and a first guide pipe having a first end connecting to an exit portion of said first induced draft device and a second end engaged to a second end of said truncated cone-portion:

a waste gas exhaust means having:

a second induced draft device mounted on said bottom sheet and near said right sheet;

a second guide pipe having a first end passing through said closing member and connected to said opening portion of said horizontal passage member and a second end engaged to a draw portion of said second induced draft device; and a third guide pipe having a first end passing through said rear sheet and connected to an exit portion of said second induced draft device and a second end extending to said outside atmosphere;

a feeding means having:

a feeding device including a fixing portion engaged to the back of said middle sheet, a pipe body portion penetrating said fixing portion and passing through said middle sheet and having a front end engaged to said fuel inlet, a sustain portion formed on a rear section of said pipe body portion and communicating with the middle section of an axis hole of said pipe body portion, a screw lift shaft rotatably engaged within said pipe body portion, and a driving device mounted on a back of said pipe body portion to drive said screw lift shaft; and a container mounted under said top sheet and having a fall portion slanted toward said sustain portion, and having a receiving space for wood pellets;

a control system means for controlling the quantity of wood pellets fed into said feeding means.

2. A wood pellet stove according to claim 1, further comprising a cleaning means which having:

three scrape members each of which includes:

a scrape plate having four holes each of which is respectively slidably engaged around one set of said four pipes a screw hole at a center of said scrape plate;

a rod threaded to said screw hole and passing through one of said three guide pipes, one of said two vertical plates and said front sheet;

a hoop element secured on an outer end of said rod and disposed outside of said front sheet.

3. A wood pellet stove according to claim 2, wherein said heat exchanger means further includes:

an L-shaped bottom partition member having a horizontal plate portion fixed to said bottom plate and a vertical plate portion disposed between a first and a second row of said three vertical rows of said pipes, said vertical plate portion having a height slightly higher than a third pipe of said four pipes counted from said bottom plate; and a top partition member having a base plate covering said a second rectangular hole of said top plate of said main member, a partition plate extending from a bottom of said base plate, fire-resistant cotton engaged to said bottom of said base plate, said partition plate being disposed between a second row and a third row of said three vertical rows of said partition plate and extending below a second pipe of said four pipes counted from said bottom plate.

4. A wood pellet stove according to claim 3, wherein said left plate portion of said closing member further includes a plurality of connecting portions respectively disposed between holes and having a convex surface.

5. A wood pellet stove according to claim 3, wherein said left sheet further has a control plate having a plurality of pressing buttons thereon.

6. A wood pellet stove according to claim 3, wherein said bottom sheet, said left sheet, said right sheet, said middle sheet, said rear sheet and said top sheet of said body and said front sheet are assembled together by means bolt members.

7. A wood pellet stove according to claim 5, wherein said rear sheet further has a plurality of ventilating holes.

8. A wood pellet stove according to claim 7 wherein:

said bottom plate of said main member further has a left screw hole and a right screw hole;

said top member further having a first hole disposed on a right side;

a reverse U-shape element having a second threaded hole and fixed on a left side of said top member;

a right bolt member passing through said first hole and threaded to said right screw hole;

a left bolt member passing through a compression spring and said second hole and threaded to said left screw hole, wherein said burning means is positioned on said bottom plate.

9. A wood pellet stove according to claim 8 wherein further has two second pillars each having a first end fixed to a front section of said horizontal plate of said seat member and a second end fixed to a front section of said bottom plate of said main member.

10. A wood pellet stove according to claim 9, wherein said container of said burning means further has two second pillars each having a first end fixed to a front section of said horizontal plate of said seat member and a second end fixed to a front section of said bottom plate of said main member.

11. A wood pellet stove according to claim 10, wherein said container of said burning means further has two screw rods disposed on opposite sides of a top section of said vertical tub portion with said two handles screwed thereon.

12. A wood pellet stove according to claim 11, wherein said bottom sheet, said left sheet, said right sheet, said middle sheet, said rear sheet and said top sheet of said body and said front sheet are assembled together by means bolt members.

13. A wood pellet stove according to claim 1, wherein said heat exchanger means further includes:

an L-shaped bottom partition member having a horizontal plate portion fixed to said bottom plate and a vertical plate portion disposed between a first and a second row of said three vertical rows of said pipes, said vertical plate portion having a height slightly higher than a third pipe of said four pipes counted from said bottom plate; and a top partition member having a base plate covering said a second rectangular hole of said top plate of said main member, a partition plate extending from a bottom of said base plate, fire-resistant cotton engaged to said bottom of said base plate, said partition plate being disposed between a second row and a third row of said three vertical rows of said partition plate and extending below a second pipe of said four pipes counted from said bottom plate.

14. A wood pellet stove according to claim 13, wherein said bottom sheet, said left sheet, said right sheet, said middle sheet, said rear sheet and said top sheet of said body and said front sheet are assembled together by means bolt members.

15. A wood pellet stove according to claim 1, wherein said bottom sheet, said left sheet, said right sheet, said middle sheet, said rear sheet and said top sheet of said body and said front sheet are assembled together by means bolt members.

* * * * *